United States Patent [19]

Grady

[11] 4,162,420

[45] Jul. 24, 1979

[54] X-RAY TUBE HAVING ROTATABLE AND RECIPROCABLE ANODE

[76] Inventor: John K. Grady, 277 Baker Ave., West Concord, Mass. 01781

[21] Appl. No.: 912,185

[22] Filed: Jun. 5, 1978

[51] Int. Cl.[2] ..... H01J 35/10

[52] U.S. Cl. ..... 313/60; 313/149; 313/152

[58] Field of Search ..... 313/60, 146, 149, 152

[56] References Cited

U.S. PATENT DOCUMENTS 3,836,805 9/1974 Kok ..... 313/60

*Primary Examiner*—Robert Segal
*Assistant Examiner*—Darwin R. Hostetter
*Attorney, Agent, or Firm*—James H. Grover

[57] ABSTRACT

An X-ray tube including an envelope enclosing a flat-edged anode disc rotatable and axially reciprocable and further enclosing an electron beam source for projecting electrons along a beam axis toward the edge of the anode disc. The beam source is disposed to direct its beam at an acute angle of incidence to the edge of the anode disc and produce X-rays which are transmitted through a window in the envelope.

11 Claims, 3 Drawing Figures

X-RAY TUBE HAVING ROTATABLE AND RECIPROCABLE ANODE

BACKGROUND OF THE INVENTION

A rotatable anode X-ray tube usually comprises an envelope which surrounds a rotatably mounted anode disc that acts as a target and has a marginal portion called a focal track. Generally, this track is made of a relatively high atomic number material such as tungsten or molybdenum which readily emits X-rays when bombarded by high energy electrons. A source of electrons is disposed to direct the high energy beam on to the focal track and thereby generate X-rays which emanate therefrom. The focal track portion of the anode disc is generally disposed at a predetermined target angle with respect to the plane of the disc so that the focal spot area is inclined toward a radially aligned X-ray transparent window in the envelope. Thus the X-rays pass in a beam through the window and appear to be emanating from a radial projection of the focal spot area in the tube.

A substantial portion of the electron beam energy that strikes the focal track area is converted to heat which is manifested by a sharp increase in temperature of the target material, frequently as high as 3000° C. In order to avoid pitting or otherwise damaging the focal track surface, the anode disc is rotated at high angular velocities, frequently in the order of 10,000 to 20,000 RPM for example, to move successive segments of the focal track rapidly through the focal spot area that is aligned with the electron beam. As the focal track and target disc rotate, the particular areas which are not being struck with the electrons from the cathode are given an opportunity to cool through radiant dissipation of the heat. Though some heat is dissipated through radiant energy, the heat build up in the disc is frequently greater than the amounts which are dissipated and when the electron beam continues to impinge upon the same track in subsequent rotations of the target disc, the material will become over-heated and possibly permanently damaged. Also, if the tube is allowed to overheat, the bearings on the shaft which support the disc within the envelope can become inoperative.

Most rotating anode target structures which have been disclosed to the prior art included a beveled edge with the cathode beam impinging upon the beveled surface which in turn generated the X-rays and directs them through the window. Frequently, the beveled portion of the target anode is a layered bimetallic construction which readily conducts heat from the focal track area into the body of the anode. Such structures are not wholly satisfactory and do not allow maximum loads of cathode ray bombardment over a reasonably long period of time without causing over-heating.

Rotating anode X-ray tubes in which the electrons impinge upon changing surfaces are known to the art. U.S. Pat. No. 3,836,805 to Kok discloses an anode that is carried on a rotor driven by a stator and including a pinion gear movable on a slide so that the electron spot changes along the axis of the anode disc as the anode is rotated. The anode is axially shifted in response to a heat sensing device which drives the pinion gear and changes the positioning of the focal track. With the disclosed construction, the anode can produce substantial amounts of off-focus radiation which especially occurs because the cathode rays are directed at right angles to the surface of the anode, unlike the proposed construction.

The U.S. Pat. No. 2,926,270 to Zunick discloses a disc shaped, bevel-type anode which is rotated and wobbled to alter the track upon which the electrons impinge. Upon continual use, this relatively heavy anode can misalign easily from the desired axial setting of the tube and produce off-focus radiation.

SUMMARY OF THE INVENTION

According to the present invention, we have discovered an X-ray tube which includes a target disc having a cylindrical emitting edge in which the cathode beam source is inclined at an angle with respect to the axial center line of the disc. The disc is disposed upon a shaft that is rotatably and reciprocably mounted within the envelope. As the shaft is rotated, it is simultaneously reciprocated and the disc that is supported thereon is similarly moved. Fresh surfaces on the emitting edge of the disc are continually presented as the focal spot is tracked in a sinusoidal path. The shaft which supports the disc extends from both sides of the disc and is journaled within the envelope. A rotor or armature is disposed on the shaft and cooperatively associated with a stator located externally of the envelope. The stator causes the rotor to rotate and simultaneously reciprocate on the axis of the disc.

The X-ray tube of the present invention comprises an envelope which encloses an electron beam source which includes the cathode for projecting electrons along a beam axis and further includes a window for the X-rays to emerge. An anode disc having a cylindrical X-ray emitting edge is axially rotatable and reciprocable in the envelope and has the edge in the beam axis, the edge being parallel to the axis of the disc, the beam source being disposed to direct its beam at an acute angle of incidence to the edge to produce X-rays which are transmitted through the window.

DESCRIPTION OF THE PREFERRED EMBODIMENTS

Figure 1:
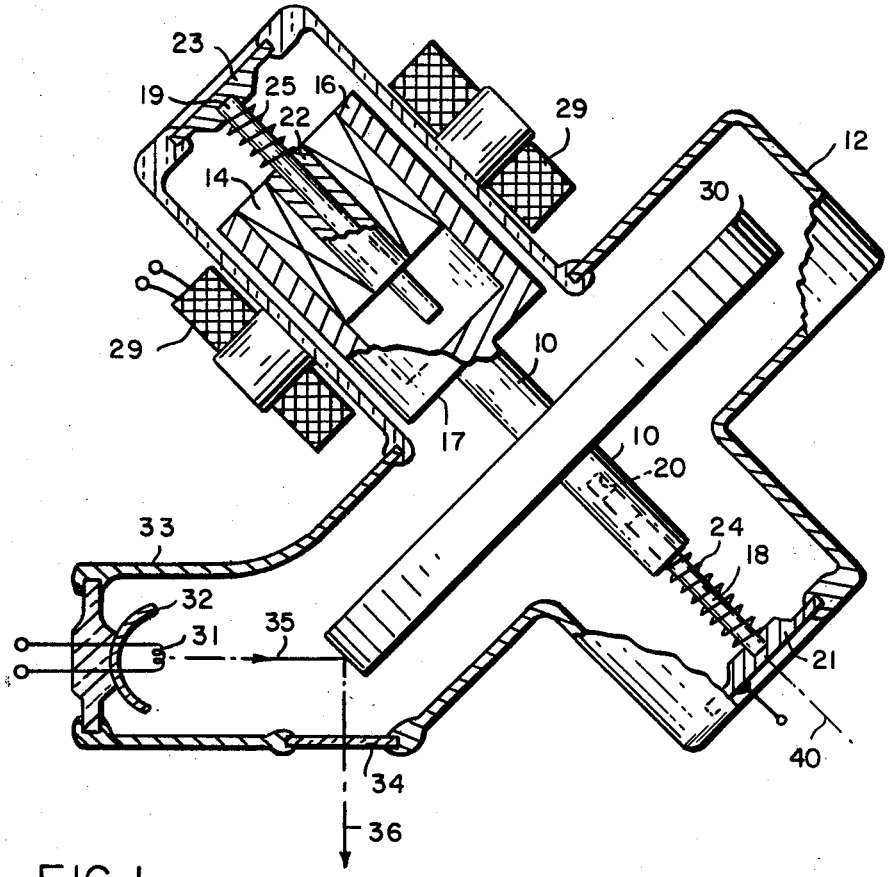
FIG. 1 is a cross-sectional view of one embodiment of the present rotating disc X-ray tube.

In FIG. 1, an axially disposed shaft 10 is located within a central potion of an envelope 12 and rotatably held at one end by a first rod 18 that is housed within an axial bore 20. The other end of shaft 10 is connected to an armature 16 by means of shoulder 17 to form a hollow cylinder. Bearing surface 14, which conventionally may be ball bearings, is disposed between a hollow journal member 22 and the inside of armature 16 to provide for rotation of anode 30. A second rod 19 is aligned on the axis of shaft 10 and is slidably disposed within journal member 22 (suitable bearings may be included, as desired) and arranged to allow reciprocation of shaft 10 when actuated. Both rods 18 and 19 are fixedly disposed in supporting end caps 21 and 23 that are sealed to the envelope 12. As with rod 19, suitable bearings can be provided in bore 20 to allow for rotational and axial movement. Quite importantly, since both ends of the shaft which support the disc 30 are disposed in the envelope, the disc 30 will not wobble while it is operating. A pair of springs 24 and 25 are disposed over rods 18 and 19 and each biases at one end against a respective end cap. The other ends of the springs bias against the shaft 10 and the bearing surface 22 respectively so as to constantly urge the shaft 10 toward the rest position shown.

A cathode 31, partially surrounded by a reflective surface 32, is disposed in a housing 33 which extends from the side of envelope 12. A beam of high energy electrons 35 flows from cathode 31 to strike rotary disc 30 and generate X-rays 36 which pass through a window 34 provided in envelope 12. When the beam of electrons 35 strikes the disc 12, an extremely hot focal spot develops which causes the tungsten or molybdenum metal to produce the beam of X-rays 36. The disc 30 is rotated on axis 40 with shaft 10 by means of a stator or inductive winding 29 which is located in an externally encircling relation to rotor 16. Inductive winding 29 can cause disc 30 to rotate at speeds of 10,000 to 20,000 revolutions per minute to constantly present different surfaces to the flow of electrons from source 31 instead of bombarding a single immovable focal spot area. While such rotation can allow for increased power loadings upon the disc 30 from source 31, the heat generated by the focal spot is not entirely dissipated as the disc completes a revolution and impingent of the beam upon a single plane in the disc 30 is not wholly satisfactory. According to the present invention, the disc 30 is provided with a flat surface, generally with a thickness of 5 to 25 mm, coplanar with the axis of shaft 10. Axial movement of the disc 12 is limited to approximately 80% of its thickness so that electron beam 35 always strikes a portion of the flat surface. When the rotor 6 is started by applying current to inductive winding 29, an initial force will be applied to the rotatable members which combines a gyroscopic recessional force and an electromotive force that rotates the shaft and shifts it at right angles to the winding 34 to cause it to move axially on rods 18 and 19. The first axial thrust of the armature compresses one spring nearly fully. The springs then cooperatively reciprocate the rotor and disc attached thereto with an oscillatory motion. Friction gradually dampens the oscillatory motion, within about 1–10 seconds, but surface of the disc 10 has been exposed to the beam 35, not in a sinusoidal shape with wave forms of constant amplitude but rather with wave forms of diminishing amplitudes. Such wave forms of decreasing amplitude trace an irregular path upon the flat portion of the disc 30 thereby avoiding a replication of the track of the focal spot and reducing the concentration of heat.

As the disc 30 oscillates on its axis, the electron beam 35 will strike it at the same incidence angle because of the flat surface. Thus, the X-rays beam 36 emitted by the disc 30 will remain in the same path and pass through the window 34 to produce constant radiation upon the subject being X-rayed. With an angle of 7° to 15°, the X-ray beam 36 that is produced is directed out window 34 as shown. The major surfaces of disc 30, as well as a major portion of the periphery of disc 30 are not accessable to electron bombardment. This greatly reduces off-focus radiation, which is a major problem with conventional designs.

Figure 2:
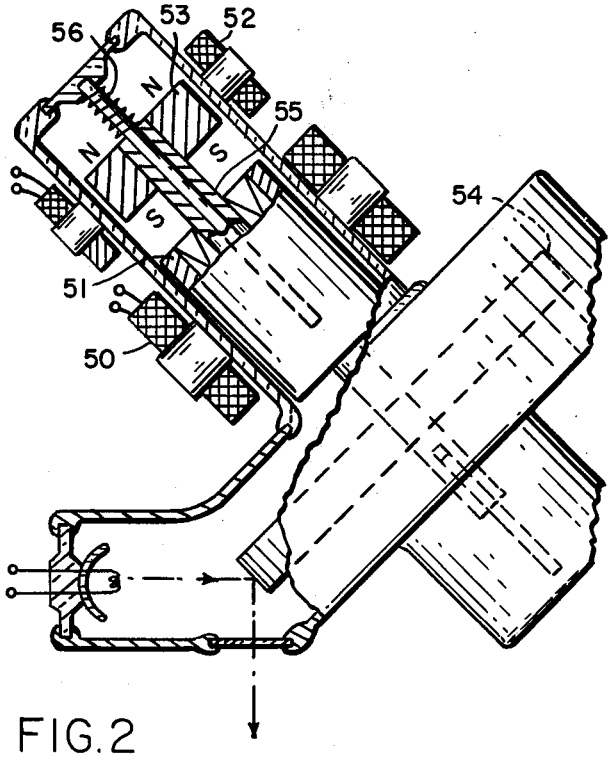
FIG. 2 is a cross-sectional view of another embodiment of the present invention.

In FIG. 2, an X-ray tube is shown which is similar to the tube of FIG. 1. The principal difference between the tubes is that instead of utilizing only the electromotive and gyroscopic recessional forces to shift the disc axially, a solenoid-type device is also disposed within the envelope. While the inductive winding 50 drives the rotor 51 in a manner similar to that described previously, from time to time current is momentarily passed into inductive winding 52 thereby causing a magnet 53 to shift. Since magnet 53 is fixedly attached to shaft 55, shaft 55 and disc 54 are carried with it, again causing an oscillating motion as described with reference to FIG. 1. Again, however, the focal track does not form a sinusoidal wave of fixed amplitude, but rather the amplitude diminishes because of the dampening effect of friction.

Figure 3:
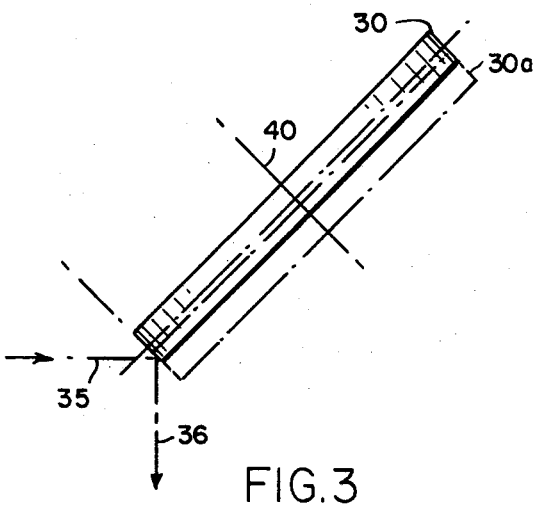
FIG. 3 is a view of the disc illustrating the incidence angle of cathode ray beams and the path of the X-ray which are produced and depicting two positions of reciprocation for the disc.

In FIG. 3, the disc is shown at two levels as it moves on its axis 40 due to oscillation. Beam 35 will produce X-rays beams 36 emitted at the same angle, irrespective of whether the disc 30 is in the uppermost position as shown in solid lines or in the lowermost position, **30*a***, as shown in phantom lines.

It is apparent that modifications and changes can be made within the spirit and scope of the present invention. It is my intention, however, only to be limited by the scope of the appended claims.

I claim:

1. An X-ray tube comprising:

an envelope enclosing an electron beam source including a cathode for projecting electrons along a beam axis and including a window for X-rays to emerge;

an anode disc axially rotatable and reciprocatable and having its edge in the path of the beam axis, said edge being parallel to the axis of the disc, said beam source being disposed to direct the electron beam at an acute angle of incidence to the edge to produce an X-ray that is transmitted through said window;

means to rotate and reciprocate said anode on its axis.

2. The X-ray tube according to claim 1 wherein said disc is disposed on a shaft, said shaft extending along the axis from both sides of said disc, each end of said shaft being supported within said envelope.

3. The X-ray tube according to claim 2 wherein the means to rotate and reciprocate said disc is an armature disposed on said shaft within said envelope and a stator coaxially disposed about said armature outside of said envelope whereby when current is applied to said stator, axial rotation and reciprocation of the disc is induced and the electron beam emitted from the cathode will trace a sinusoidal path of diminishing amplitudes upon the disc.

4. The X-ray tube according to claim 2 wherein the means to reciprocate the disc on its axis is a magnet disposed on said shaft within said envelope cooperatively associated with a stator disposed on the outside of said envelope whereby when current is momentarily applied to said stator, said magnet will be moved on the axis of the disc to cause the electron beam emitted from the cathode to trace a sinusoidal path of diminishing amplitude upon the side of said disc.

5. The X-ray tube according to claim 4 wherein spring means are disposed on each end of said shaft to bias said disc in an axial direction opposite to the direction in which it is forced when current is applied.

6. The X-ray tube according to claim 1 wherein the portion of the envelope enclosing the cathode is disposed coaxial with the electron beam axis, and the axis of the disc anode is inclined relative to the electron beam axis so that the electron beam strikes the edge of the disc at an acute angle.

7. The X-ray tube according to claim 1 wherein the edge of the disc is a cylindrical surface coaxial with the disc axis.

8. The X-ray tube according to claim 1 wherein the disc thickness of the flat surface is between about 5 to 25 mm.

9. An X-ray tube comprising:

an envelope enclosing an electron beam source including a cathode for projecting electrons along a beam axis said envelope being disposed coaxial with the beam axis and including a window for X-rays to emerge;

an anode disc axially rotatable and reciprocatable disposed within said envelope and having its edge in the path of the beam axis, said edge being parallel to the axis of the disc, the axis of said electron beam source being disposed at an acute angle relative to the axis of said anode disc, said electron beam being directed to strike the edge of the disc at an acute angle to produce X-rays which are emitted along an axis at substantially right angles to the electron beam and are transmitted through said window;

means to rotate and reciprocate said anode on its axis.

10. The X-ray tube according to claim 9 wherein the edge of the disc is a cylindrical surface, coaxial with the disc axis.

11. The X-ray tube according to claim 10 wherein the disc thickness of the flat surface is between about 5 to 25 mm.

* * * * *